US005265838A

United States Patent [19]

Kjellman

[11] Patent Number: 5,265,838

[45] Date of Patent: Nov. 30, 1993

[54] HUB CONSTRUCTION FOR ROTATABLE CHAIR

[75] Inventor: Fredrik Kjellman, Jakobstad, Finland

[73] Assignee: F:ma Mekrapid, Jakobstad, Finland

[21] Appl. No.: 793,435

[22] PCT Filed: May 9, 1990

[86] PCT No.: PCT/FI90/00127

§ 371 Date: Dec. 2, 1991

§ 102(e) Date: Dec. 2, 1991

[87] PCT Pub. No.: WO90/13242

PCT Pub. Date: Nov. 15, 1990

[30] Foreign Application Priority Data

May 10, 1989 [FI] Finland ..... 892250

[51] Int. Cl.[5] ..... F16M 13/00; A47C 3/00

[52] U.S. Cl. ..... 248/417; 248/289.3

[58] Field of Search ..... 248/417, 289.3, 145, 248/415, 418; 297/349; 16/284, DIG. 10

[56] References Cited

U.S. PATENT DOCUMENTS

| | | | |
|---|---|---|---|
| 1,299,810 | 4/1919 | Toole | 248/417 |
| 1,386,621 | 8/1921 | Hughes | 248/289.3 X |
| 1,532,354 | 4/1925 | Walton | 248/417 |
| 1,695,725 | 12/1928 | Wolfe | 248/417 |
| 2,351,194 | 6/1944 | Davies | 248/417 |
| 3,207,464 | 9/1965 | Hrach | 248/417 |
| 3,223,376 | 12/1965 | Ciuffini et al. | 248/417 |
| 3,385,550 | 5/1968 | Doerner | 248/417 |
| 3,837,611 | 9/1974 | Rhoades | 248/417 |

FOREIGN PATENT DOCUMENTS

| | | | |
|---|---|---|---|
| 300255 | 7/1972 | Austria . | |
| 3828321 | 4/1989 | Fed. Rep. of Germany . | |
| 1237231 | 6/1960 | France | 248/289.3 |
| 321453 | 6/1957 | Switzerland . | |

*Primary Examiner*—Karen J. Chotkowski

*Attorney, Agent, or Firm*—McGlew and Tuttle

[57] ABSTRACT

The invention is related to a hub construction for a rotatable chair, which automatically returns to the initial position when the chair is relieved. The hub construction comprises a vertical shaft (1) fastened to the lower side of the seat of the chair and a hub (2) on the leg portion of the chair, to which hub (2) the lower portion of the shaft (1) is rotatably fastened. The return movement is achieved by means of a cam surface (5) acting in the axial direction and located on the end of a spring loaded sleeve (6) enclosing the shaft (1), which cam surface (5) is arranged to cooperate with a radially directed guide pin (4). The invention is characterized in that the guide pin (4) is fastened to the lower portion of the shaft (3) and that the spring loaded sleeve (6) is mounted torsionally rigidly on the hub (2).

9 Claims, 4 Drawing Sheets

HUB CONSTRUCTION FOR ROTATABLE CHAIR

FIELD OF THE INVENTION the present invention relates to a hub construction for a rotatable chair, which automatically returns to the initial position when the chair is relieved, comprising a vertical shaft fastened to the lower side of the seat of the chair and a hub on the leg portion of the chair, to which hub the lower portion of the shaft is rotatably fastened, whereby the return movement is achieved by means of a cam surface acting in the axial direction and located on the end of a spring loaded sleeve enclosing the shaft, which cam surface is arranged to cooperate with a radially directed guide pin.

Background of the Invention

Previously known constructions of returning mechanisms for rotary chairs cannot be applied to chairs with a very heavy construction normally used e.g. in TV-chairs. The known constructions specifically require an excessively large spring force for achieving the desired return movement, which has an adverse effect on the sitting comfort and results in very clumsy constructions. The known constructions normally have two opposite return positions, because of which the chair returns to the position located nearest when the chair is relieved, i.e. when the person sitting on it stand up. As a result, such a construction does not result in a chair, which when left free always returns to the aesthetically most natural position.

The German application DE-OS 3 828 321 described a hub construction according to the introduction, which is however only suited to light chair constructions, such as bar stools and the like. In addition, the manufacturing of this known construction is relatively complex, since the spring loaded sleeve is mounted torsionally rigidly on the shaft of the hub construction. Especially, the manufacturing and working of the shaft and the sleeve is laborious and complicated. As a result of the relatively temporary bearing arrangement mentioned in the description, it is hardly probable that a sufficient spring force can be achieved for ensuring a reliable operation.

Summary and Object of the Invention

The object of the present invention is to eliminate all said drawbacks, which is achieved by means of a hub construction characterized in that a guide pin is fastened to the lower portion of the shaft and that a spring loaded sleeve is mounted torsionally rigidly on the hub.

This construction results in an extremely good sitting comfort, since the return force is barely noticeable when sitting on the chair. The construction itself is very simple and reliable and has practically no effect on the appearance of the chair hub.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

Brief Description of the Drawings

The invention is next described in more detail with reference to the accompanying drawing, in which.

Detailed Description of the Preferred Embodiments

The inventive hub construction comprises a fixed vertical shaft 1 fastened to the lower side of a seat of a rotatable chair, and a hub 2 on the leg portion of the chair, to which hub 2 the lower portion of the shaft 1 is rotatably fastened. The hub 2 has externally the form of a truncated pyramid, whereby each side **2*a* is provided with threaded fastening holes 3 for the legs of the chair. The number of side 2*a*** in the pyramid thus determines the number of legs in the leg portion of the chair.

Figure 1:
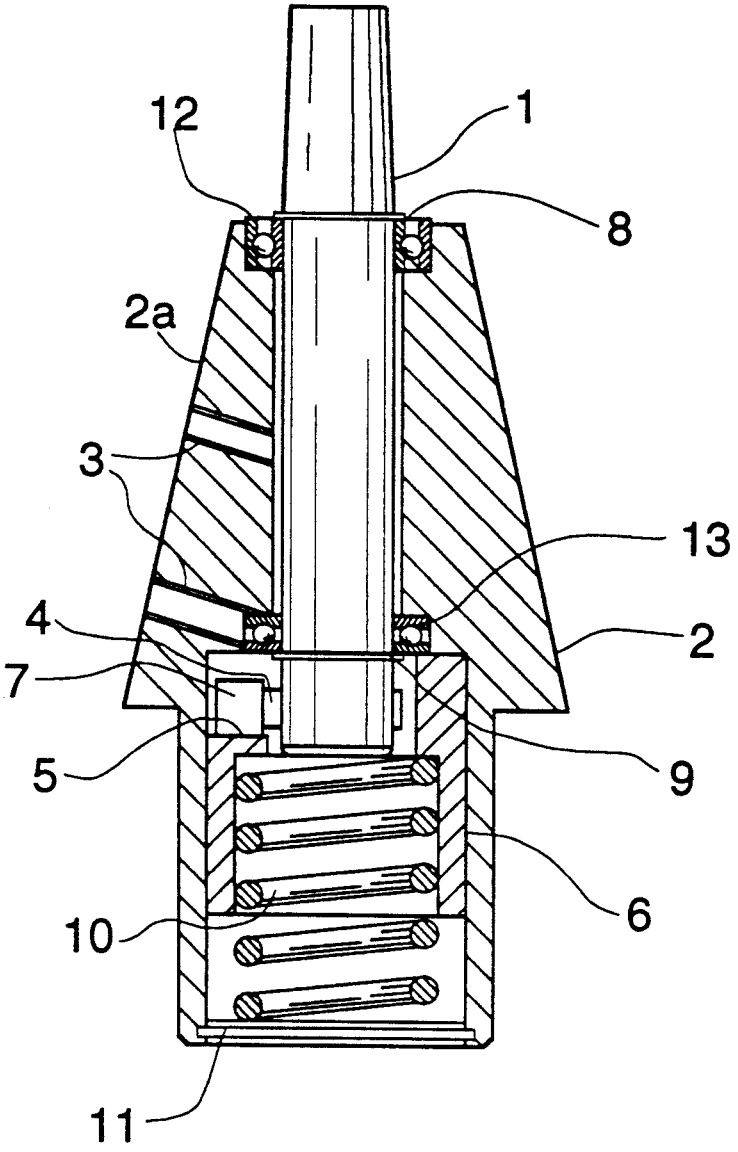
FIG. 1 shows an example of a hub construction according to the invention in a side sectional elevation.
Figure 2:
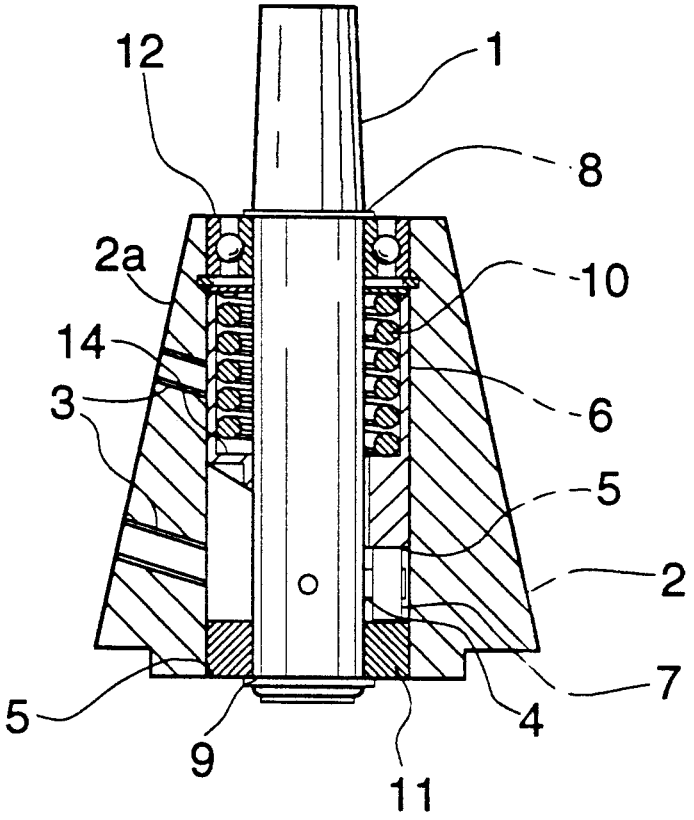
FIG. 2 shows another example of a hub construction according to the invention in a side sectional elevation.
Figure 3:
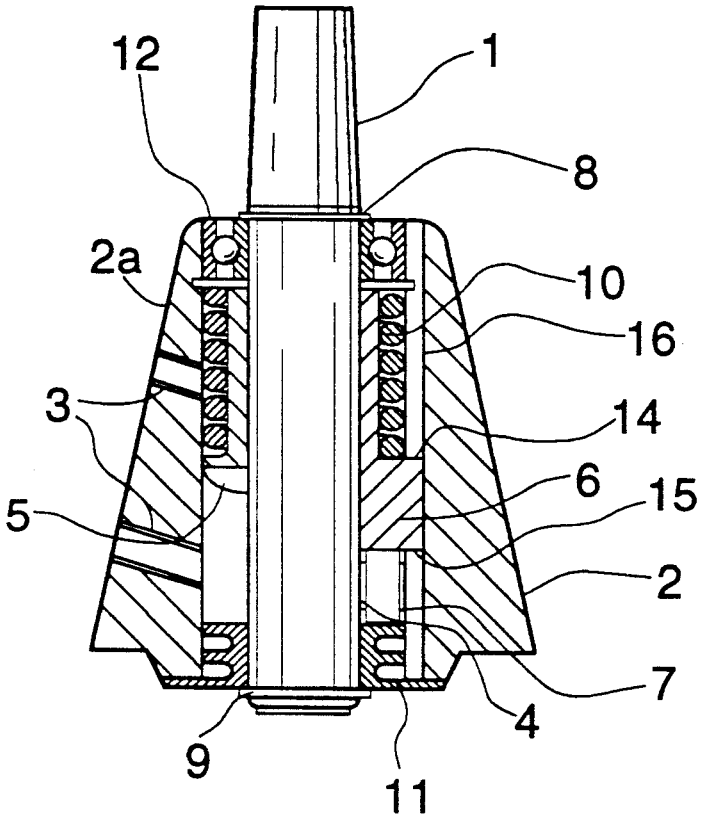
FIG. 3 shows the most preferred embodiment of a hub construction according to the invention in a side sectional elevation.
Figure 4:
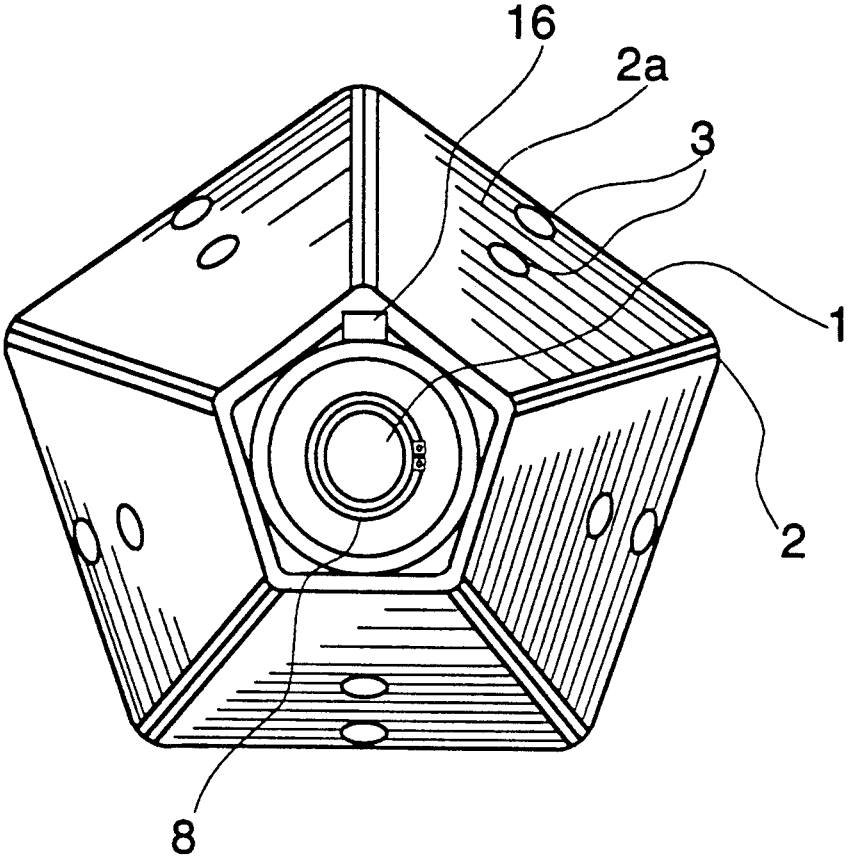
FIG. 4 shows an example of a hub according to the invention in top view.

The vertical shaft 1 has in its lower portion a radially projecting guide pin 4, which is arranged to be located against a cam surface 5 acting in the axial direction and located on the end of an axially movable sleeve 6 spring loaded in the direction against the cam surface 5, which sleeve 6 encloses the shaft 1. When the chair is empty, the sleeve 6 is pushed by the spring force against the guide pin 4 on the axially stationary shaft 1, whereby the cam surface 5 via the guide pin 4 forces the shaft 1 to turn until the guide pin 4 is placed against the stable rest position of the cam surface 5, in which rest position the height of the sleeve 6 is at its lowest, which position is illustrated in FIG. 1. When the leg portion of the chair is adjusted in such a way that the seat of the chair in this rest position points at the desired direction, it is ensured that the chair, independently of the direction it is currently turned when being relieved, automatically returns to its adjusted initial position in an elegant and secure manner. When the seat of the chair is turned from its initial position in one direction, the shaft 1 turns, whereby the guide pin 4 advancing along the cam surface 5 presses the sleeve 6 against the spring force, which then increases and is able to return the seat to its initial position as soon as the chair is relieved. Since the return movement is achieved by means of the guide pin 4 and the cam surface 5 on the spring loaded sleeve 6, the seat of the chair and thereby the shaft 1 can be turned without limitation by a large number of revolutions in one direction, after which it can return by the shortest route to its initial position, which results in a return movement of max. 180°. In FIG. 2 and 3 there is shown the position, in which the spring force is at its highest.

A roller 7 is preferably mounted around the guide pin 4 for ensuring that the friction between the cam surface 5 and the guide pin 4 is as low as possible.

In accordance with an inventive embodiment, the cam surface is arranged on the upper end of the sleeve 6, whereby a pressure spring 10 is fitted between the bottom plate 11 of the hub construction and the sleeve 6 and applies an upward force on the sleeve 6. If the shaft 1 is pivoted on the hub 1 only by means of a long plastic slide bearing or a short slide hearing 12 on the upper end of the hub 2 and a roller bearing 13 immediately above the guide pin 4, a construction is achieved, in which the friction between the shaft 1 and the hub 2 is sufficiently high so that the seat does not return to the initial position as long as the chair is occupied, but immediately when the chair is relieved, the pressure spring 10 is able to press the sleeve 6 upward against the roller 7 on the guide pin 4 of the shaft 1 in such a way that the friction force caused by the gravitational force of the seat between the shaft 1 and the hub 2 is practically totally eliminated, whereby the pressure spring 10 in cooperation with the cam surface 5 is able to return the seat to its initial position. This embodiment gives a slightly longer length to the hub construction itself, since the shaft 1 and the pressure spring 10 are mainly located one after the other.

A shorter construction can be achieved, if the cam surface 5 is arranged on the lower end of the sleeve 6 and the pressure spring 10 on the upper portion of the hub 2 in such a way that the pressure spring 10 encloses the shaft 1 and is arranged to apply a downward force to the sleeve 6. For obtaining a sufficiently low friction between the shaft 1 and the hub 2, it is in this case most preferable to arrange a roller bearing 12 on the upper end of the hub 2, which roller bearing is by means of a locking washer 8 arranged to support the whole gravitational force acting on the shaft 1. This results in such a low friction between the shaft 1 and the hub 2 that the bearing arrangement on the lower end of the hub 2 can preferably be comprised of a plastic sleeve serving as a friction bearing 11. The pressure spring 10 should most preferably be dimensioned so that the return force the pressure spring 10 applies on the shaft 1 is lower than the friction force on the friction bearing 11 as long as the chair is occupied, but is sufficient to return the chair to the initial position immediately after the chair is relieved.

In accordance with an embodiment, the sleeve 6 has a constant outer diameter along its whole length and an inner diameter, which nearest to the cam surface 5 mainly corresponds to the diameter of the shaft 1 and via a radial extension 14 increases to a larger diameter mainly corresponding to the outer diameter of the pressure spring 10, whereby the pressure spring 10 is arranged to be located within the sleeve 6, the radial extension 14 serving as a contact surface. In this case, the inner surface of the hub 2 serves as a guide for the sleeve 6. In accordance with another embodiment, the spring loaded sleeve 6 has a constant inner diameter mainly corresponding to the diameter of the shaft 1 along its whole length and an outer diameter, which nearest to the cam surface 5 mainly corresponds to the inner diameter of the hub 2 and via a radial extension 14 decreases to a smaller diameter mainly corresponding to the inner diameter of the pressure spring 10, whereby the pressure spring is arranged to enclose the narrower portion of the sleeve 6, the radial extension 14 serving as a contact surface. In this case, the shaft 1 primarily serves as a guide for the sleeve 6, and a stable construction is achieved.

For ensuring that the sleeve 6 does not turn around its shaft, it is preferably provided with a radially projecting key 15, which is arranged to advance along an axial groove 16 on the peripheral surface of the hub 2.

The cam surface 5 is preferably formed as a radially directed end surface continually ascending along two curves of 180° in opposite directions from the lowest initial point.

While specific embodiments of the invention have been shown and described in detail to illustrate the application of the principles of the invention, it will be understood that the invention may be embodied otherwise without departing from such principles.

I claim:

1. A hub construction for a rotatable chair, which automatically returns to an initial position when the chair is relieved, comprising:

a vertical shaft fastened to a bottom side of a seat of the rotatable chair;

a hub connected to a leg portion of the chair, said shaft being rotatably fastened to a lower portion of said hub;

a pressure spring positioned within said hub;

a spring loaded sleeve positioned in said hub surrounding said shaft, said spring loaded sleeve being axially slidably and torsionally rigidly mounted, said sleeve having a bottom forming a cam surface, said sleeve having a height dimension depending upon a shape of said cam surface; and a guide pin fixed to a lower portion of said shaft and directed radially outwardly out from said shaft, said guide pin cooperating with the cam surface and bearing against said cam surface, said spring loaded sleeve having a constant inner diameter over a length of said sleeve, said inner diameter corresponding to a diameter of said shaft, said spring loaded sleeve having a first portion surrounded by said pressure spring, said first portion having an outer diameter corresponding to an inner diameter of said pressure spring, said spring loaded sleeve having a second portion extending from a radial extension to said cam surface, said second portion having an outer diameter corresponding substantially to an inner diameter of said hub, said initial position of the rotatable chair being defined by an area of said cam surface wherein said height of said sleeve is the lowest.

2. A hub construction according to claim 1, wherein said spring loaded sleeve is provided with a radially projecting key on its periphery, said key being arranged to advance along an axially groove on a peripheral surface of said hub.

3. A hub construction according to claim 2, wherein said cam surface is formed as a radially directed end surface of said sleeve, said cam surface continually ascending along to opposite curves over 180° from a lowest initial point to a highest opposite point.

4. A hub construction according to claim 3, wherein a roller is mounted rotatably around said guide pin located against said cam surface.

5. A hub construction according to claim 4, wherein an upper and lower washer are arranged adjacent said hub and said shaft for preventing axially movement of said shaft relative to said hub.

6. A hub construction according to claim 5, wherein said cam surface is arranged on a lower end surface of said sleeve, said pressure spring being arranged in an upper portion of said hub acting downwardly on said sleeve.

7. A hub construction according to claim according to claim 6, further comprising a roller bearing, said shaft being mounted on said hub by means of said roller bearing on an upper end of said hub, a friction bearing in the form of a plastic sleeve being provided on a lower end of said hub around said shaft.

8. A hub construction for a rotatable chair, which automatically returns to an initial position when the chair is relieved, comprising:

a vertical shaft fastened to a bottom side of a seat of the rotatable chair;

a hub connected to a leg portion of the chair, said shaft being rotatably fastened to a lower portion of said hub;

a pressure spring positioned within said hub;

a spring loaded sleeve positioned in said hub surrounding said shaft, said spring loaded sleeve being axially slidably and torsionally rigidly mounted, said sleeve having a bottom forming a cam surface, said sleeve having a height dimension depending upon a shape of said cam surface; and a guide pin fixed to a lower portion of said shaft and directed radially outwardly out from said shaft, said guide pin cooperating with the cam surface and bearing against said cam surface, said spring loaded sleeve having a constant inner diameter over a length of said sleeve, said inner diameter corresponding to a diameter of said shaft, said spring loaded sleeve having a first portion surrounded by said pressure spring, said first portion having an outer diameter corresponding to an inner diameter of said pressure spring, said spring loaded sleeve having a second portion extending from a radial extension to said cam surface, said second portion having an outer diameter corresponding substantially to an inner diameter of said hub, said initial position of the rotatable chair being defined by an area of said cam surface wherein said height of said sleeve is the lowest, said spring loaded sleeve is provided with a radially projecting key on its periphery, said key being arranged to advance along an axially groove on a peripheral surface of said hub.

9. A hub construction for a rotatable chair, which automatically returns to an initial position when the chair is relieved, comprising:

a vertical shaft fastened to a bottom side of a seat of the rotatable chair;

a hub connected to a leg portion of the chair, said shaft being rotatably fastened to a lower portion of said hub and being connected to an upper portion of said hub via a roller bearing;

a spring positioned within said hub; and a spring loaded sleeve positioned in said hub surrounding said shaft, said spring loaded sleeve being axially slidably and torsionally rigidly mounted, said sleeve having a bottom forming a cam surface said sleeve having a height dimension depending upon a shape of said cam surface; and a guide pin fixed to a lower portion of said shaft and directed radially outwardly out from said shaft, said guide pin cooperating with the cam surface and bearing against said cam surface, said sleeve having a constant inner diameter over a length of said sleeve, said diameter corresponding to a diameter of said shaft, said spring loaded sleeve having a first portion surrounded by said pressure spring, said first portion having an outer diameter corresponding to an inner diameter of said pressure spring, said spring loaded sleeve having a second portion extending from a radial extension to said cam surface, said second portion having an outer diameter corresponding substantially to an inner diameter of said hub, said initial position of the rotatable chair being defined by an area of said cam surface wherein said height of said sleeve is the lowest.

* * * * *